US012516615B2

(12) United States Patent
Bruce et al.

(10) Patent No.: US 12,516,615 B2
(45) Date of Patent: Jan. 6, 2026

(54) CONTROL VALVE ASSEMBLY OF A VARIABLE CAM TIMING PHASER

(71) Applicant: BorgWarner Inc., Auburn Hills, MI (US)

(72) Inventors: Adam D. Bruce, Woodstock, GA (US); Keith Feldt, Ithaca, NY (US); Chris Thomas, Dryden, NY (US)

(73) Assignee: Borg Warner Inc., Auburn Hills, MI (US)

( * ) Notice: Subject to any disclaimer, the term of this patent is extended or adjusted under 35 U.S.C. 154(b) by 0 days.

(21) Appl. No.: 18/984,012

(22) Filed: Dec. 17, 2024

(65) Prior Publication Data

US 2025/0198315 A1 Jun. 19, 2025

Related U.S. Application Data

(60) Provisional application No. 63/611,399, filed on Dec. 18, 2023.

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 2820/035; F01L 2001/34426; F01L 1/3442
See application file for complete search history.

(56) References Cited

U.S. PATENT DOCUMENTS

| | | | |
|---|---|---|---|
| 2,107,070 | A | 2/1938 | Fleury |
| 4,231,330 | A | 11/1980 | Garcea |
| 4,955,330 | A | 9/1990 | Fabi et al. |
| 6,453,859 | B1 | 9/2002 | Smith et al. |

(Continued)

FOREIGN PATENT DOCUMENTS

| | | | |
|---|---|---|---|
| AU | 2009352419 | B2 | 9/2013 |
| CA | 1327150 | C | 2/1994 |

(Continued)

OTHER PUBLICATIONS

Youtube, "Karting Kid—How to Remove Predator 212c Governor—Free Power and Speed", https://www.youtube.com/watch?v=6VonFRW-f8g, 2021, 3 pages.

(Continued)

*Primary Examiner* — Ngoc T Nguyen
(74) *Attorney, Agent, or Firm* — Howard & Howard Attorneys PLLC

(57) ABSTRACT

A control valve assembly for a variable cam timing phaser includes a valve housing defining a valve housing interior, a control valve disposed in the valve housing interior, and a weight movably coupled to the valve housing. The valve housing is configured to rotate about an axis during operation of the variable cam timing. The weight is movably coupled to the valve housing and configured to actuate the control valve between a first control valve position adjacent to the first valve housing end and a second control valve position spaced axially from the first control valve position. The weight is configured to actuate the control valve between the first and second control valve positions during rotation of the valve housing about the axis.

25 Claims, 11 Drawing Sheets

(56) References Cited

U.S. PATENT DOCUMENTS

| | | | |
|---|---|---|---|
| 9,212,574 | B2 | 12/2015 | Kashima |
| 11,261,765 | B1 | 3/2022 | Plumeau et al. |

FOREIGN PATENT DOCUMENTS

| | | | | | |
|---|---|---|---|---|---|
| DE | 2909803 | A1 | | 9/1979 | |
| DE | 4407703 | A1 | | 9/1994 | |
| DE | 102015008925 | A1 | * | 1/2016 | ..... F01L 1/344 |
| DE | 102016205787 | A1 | | 10/2017 | |
| ES | 2320507 | A1 | | 5/2009 | |
| IN | 280860 | B | | 9/2007 | |
| IN | 201714023216 | A | | 7/2016 | |
| IN | 368299 | B | | 2/2019 | |
| JP | S6187911 | A | | 5/1986 | |
| JP | H02218820 | A | | 8/1990 | |
| JP | H07332050 | A | | 12/1995 | |
| JP | 2018162776 | A | | 10/2018 | |
| KR | 20010059127 | A | | 7/2001 | |

OTHER PUBLICATIONS

English language abstract for CA 1 327 150 C extracted from espacenet.com database on Dec. 17, 2024, 2 pages.

English language abstract and machine-assisted English translation for DE 44 07 703 A1 extracted from espacenet.com database on Dec. 17, 2024, 11 pages.

Machine-assisted English language abstract and machine-assisted English translation for DE 10 2016 205 787 A1 extracted from espacenet.com database on Dec. 17, 2024, 8 pages.

English language abstract and machine-assisted English translation for ES 2 320 507 A1 extracted from espacenet.com database on Dec. 17, 2024, 18 pages.

English language abstract and machine-assisted English translation for JPS 61-87911 A extracted from espacenet.com database on Dec. 18, 2024, 4 pages.

English language abstract and machine-assisted English translation for JPH 02-218820 A extracted from espacenet.com database on Dec. 18, 2024, 5 pages.

English language abstract and machine-assisted English translation for JPH 07-332050 A extracted from espacenet.com database on Dec. 18, 2024, 4 pages.

English language abstract and machine-assisted English translation for JP 2018-162776 A extracted from espacenet.com database on Dec. 18, 2024, 14 pages.

English language abstract and machine-assisted English translation for KR 2001-0059127 A extracted from espacenet.com database on Dec. 18, 2024, 8 pages.

* cited by examiner

CONTROL VALVE ASSEMBLY OF A VARIABLE CAM TIMING PHASER

CROSS-REFERENCE TO RELATED APPLICATIONS

The present application claims priority to and all the benefits of U.S. Provisional Patent Application No. 63/611,399, filed Dec. 18, 2023, which is hereby expressly incorporated herein by reference in its entirety.

BACKGROUND OF THE INVENTION

1. Field of the Invention

The present invention generally relates to a control valve assembly and, more specifically, to a control valve assembly of a variable cam timing phaser of a variable cam timing system.

2. Description of the Related Art

Conventional variable cam timing phasers include a camshaft and a variable cam timing phaser, with the variable cam timing phaser including a housing having an arcuate outer wall disposed about an axis and defining a housing interior, a rotor disposed in the housing interior and moveable with respect to the housing, and a control valve assembly. The control valve assembly typically includes a valve housing defining a valve housing interior, and a control valve disposed in the valve housing interior that is moveable between a first control valve position and a second control valve position. To move the control valve between the first and second control valve positions, conventional variable cam timing phasers include an actuator, such as a solenoid, that moves the control valve between the first and second control valve positions. In recent years, there has been a desire to have a more compact variable cam timing phaser, which allows the variable cam timing phaser to occupy less space in an engine compartment.

As such, there remains a need to provide an improved control valve assembly of a variable cam timing phaser of a variable cam timing system.

SUMMARY OF THE INVENTION

A control valve assembly of a variable cam timing phaser includes a valve housing extending along an axis between a first valve housing end and a second valve housing end and defining a valve housing interior. The valve housing is configured to rotate about the axis during operation of the variable cam timing phaser. The control valve assembly also includes a control valve disposed in the valve housing interior and moveable along the axis between a first control valve position adjacent the first valve housing end and a second control valve position spaced axially from the first control valve position toward the second valve housing end. The control valve assembly further includes a weight movably coupled to the valve housing. The weight is configured to actuate the control valve between the first and second control valve positions during rotation of the valve housing about the axis.

A variable cam timing phaser of a variable cam timing system, with the variable cam timing system including a camshaft, includes a housing defining a housing interior, and a rotor disposed in the housing interior and moveable with respect to the housing. The rotor extends along an axis between a first rotor end and a second rotor end and defines a rotor interior. The rotor is configured to rotate about the axis during operation of the variable cam timing phaser. The variable cam timing phaser also includes a control valve disposed in the rotor interior and moveable along the axis between a first control valve position adjacent the first rotor end and a second control valve position spaced axially from the first control valve position toward the second rotor end. The variable cam timing phaser further includes a weight movably coupled to the rotor. The weight is configured to actuate the control valve between the first and second control valve positions during rotation of the rotor about the axis.

DETAILED DESCRIPTION OF THE INVENTION

Figure 1:
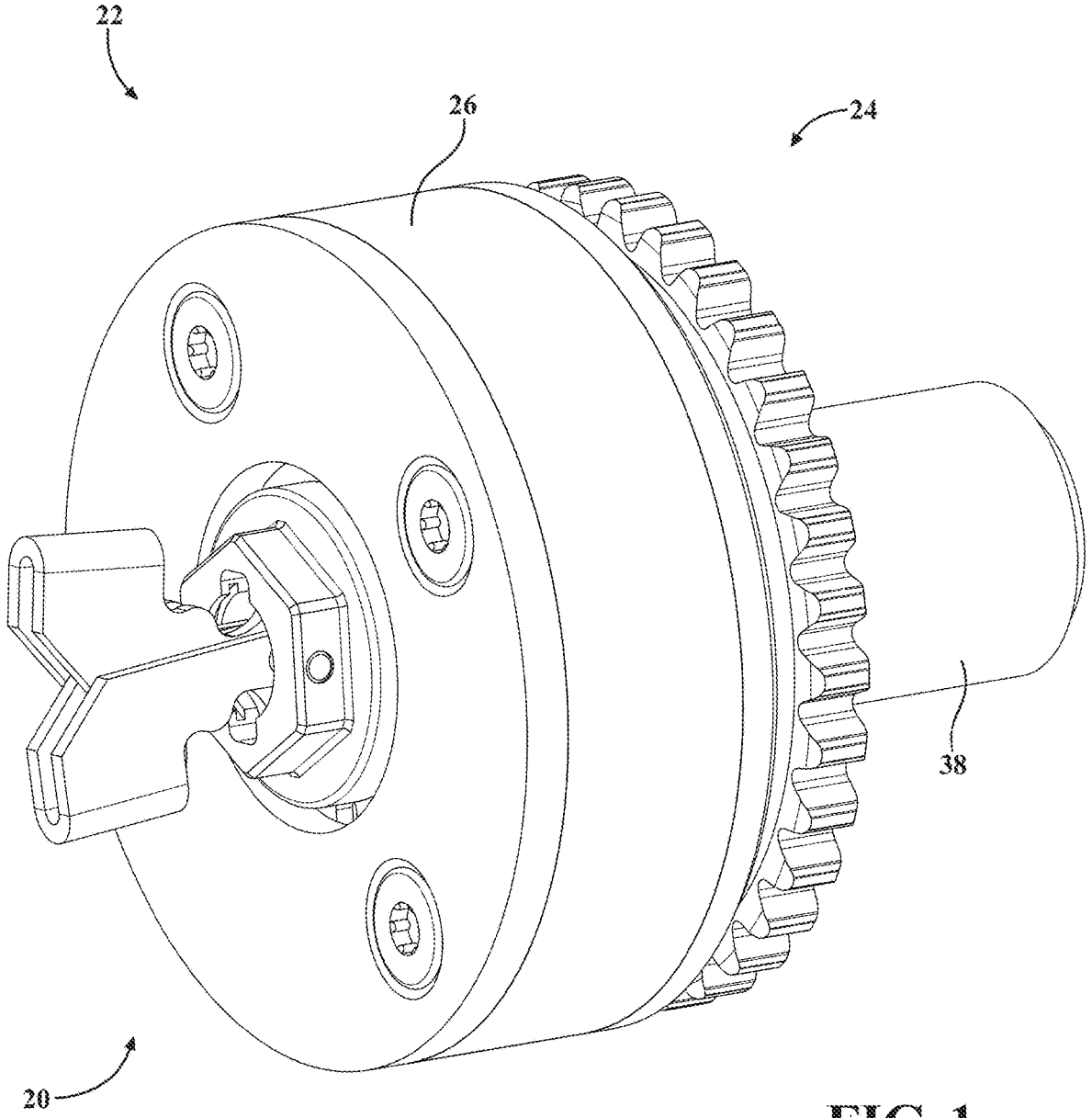
FIG. 1 is a cross-sectional view of a variable cam timing system including a variable cam timing phaser and a camshaft, and with the variable cam timing phaser including a control valve assembly and a housing.
Figure 2:
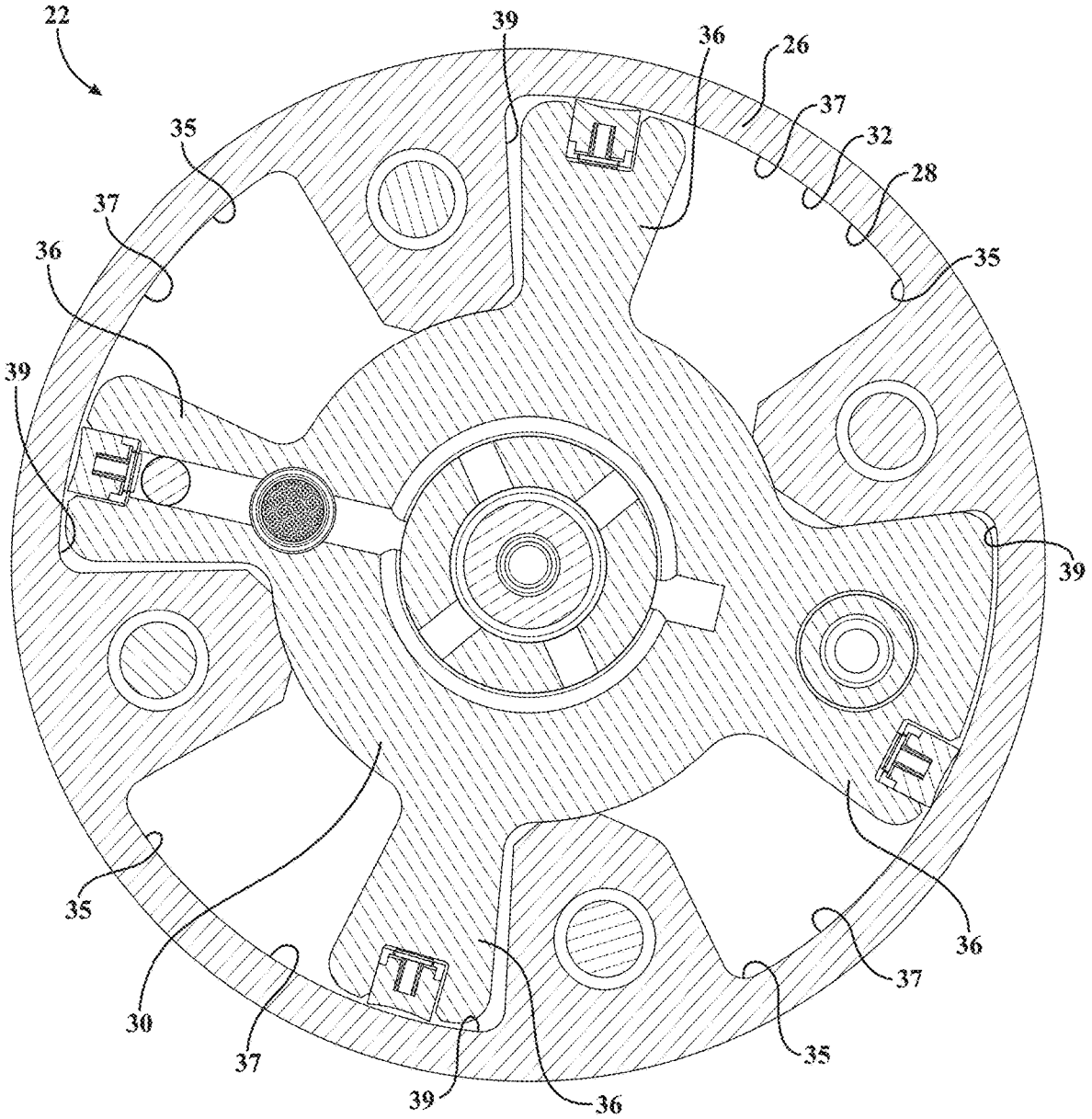
FIG. 2 is a front view of the variable cam timing system of FIG. 1, with the variable cam timing phaser including a rotor and the housing.

With reference to the Figures, wherein like numerals indicate like parts throughout the several view, control valve assembly 20 of a variable cam timing phaser 22 of a variable cam timing system 24 is shown in FIG. 1. With reference to FIG. 2, the variable cam timing phaser 22 includes a housing 26 defining a housing interior 28, and a rotor 30 disposed in the housing interior 28 and moveable with respect to the housing 26. The housing 26 may have an outer wall 32, which may have an arcuate configuration. The rotor 30 may include a hub 34 and a plurality of vanes 36 extending from the hub 34 toward the outer wall 32 of the housing 26. The plurality of vanes 36 may be integral with the hub (i.e., one piece with the hub 34) or the plurality of vanes 36 may be a separate component from the hub 34. The rotor 30 and the housing define chambers 35, with the plurality of vanes 36 dividing the chambers 35 into an advance chamber 37 and a retard chamber 39. The variable cam timing system 24 also includes a camshaft 38 rotatably coupled to the rotor 30. The variable cam timing phaser 22 may be utilized in any combustion engine that utilizes variable cam timing.

Figure 3:
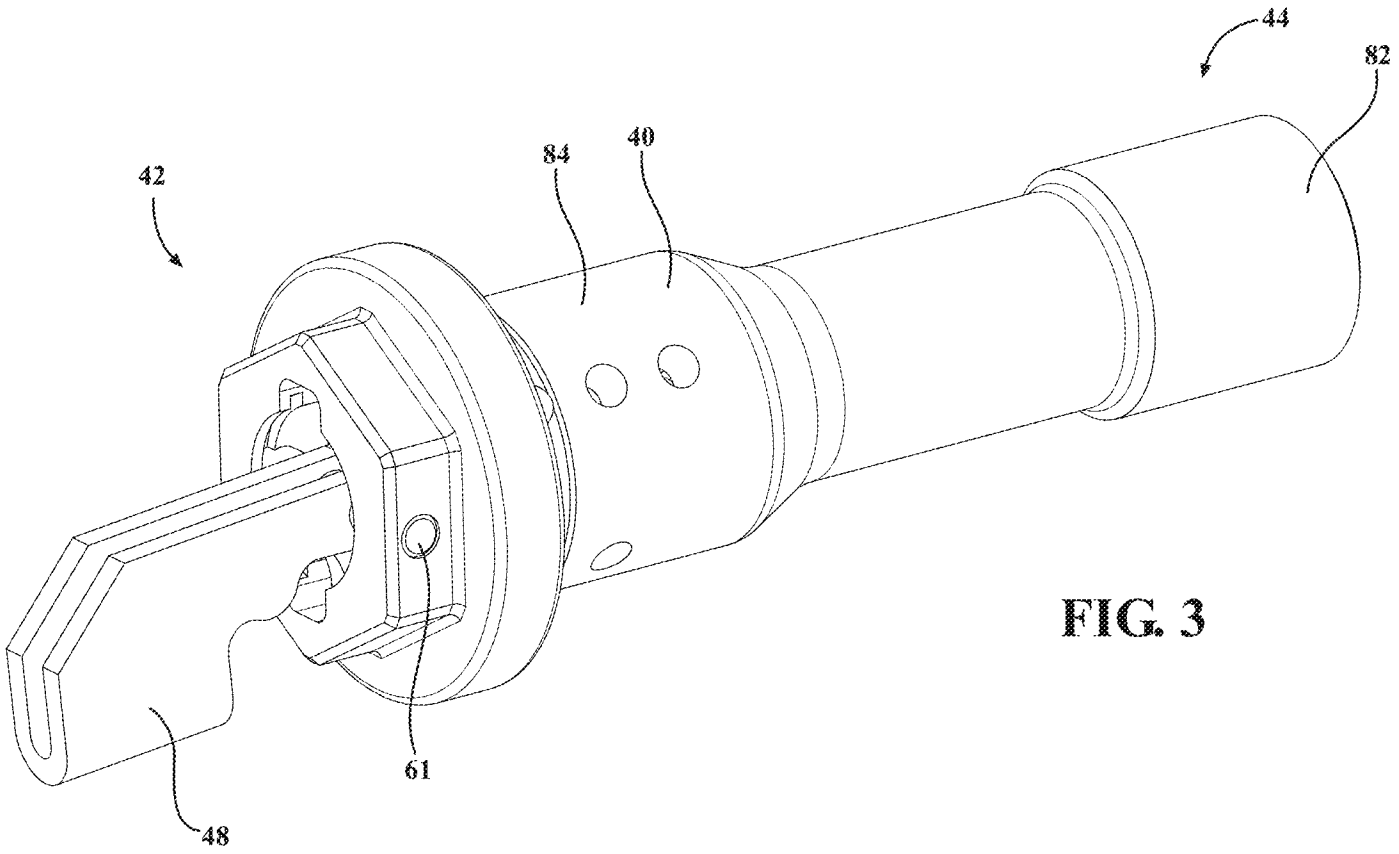
FIG. 3 is a perspective view of one embodiment of the control valve assembly, with the control valve assembly including a valve housing and a weight.
Figure 4:
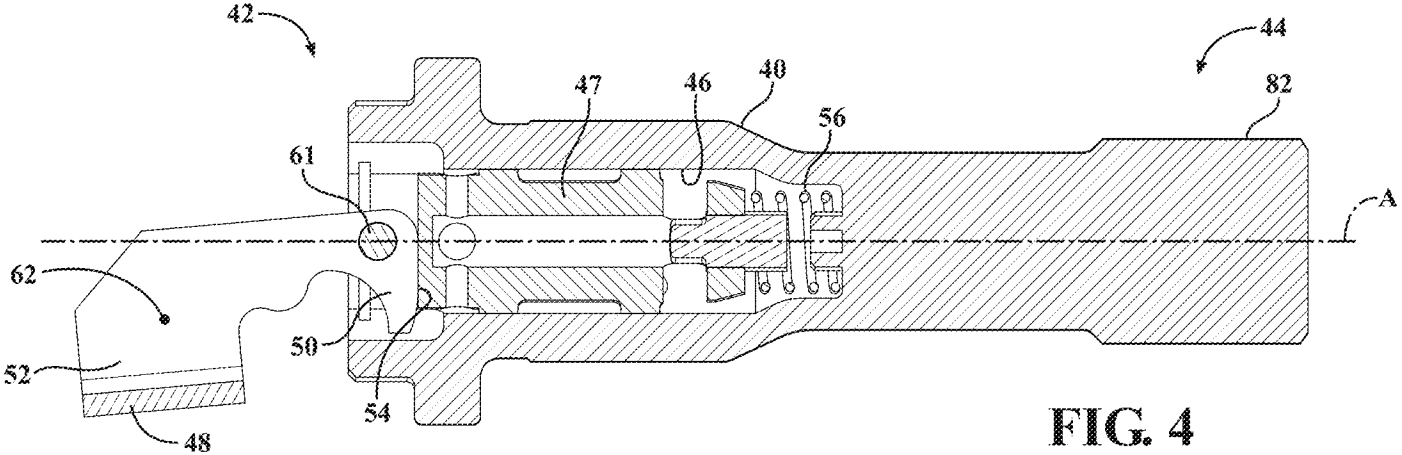
FIG. 4 is a cross-sectional view of the control valve assembly of FIG. 3, with the valve housing defining a valve housing interior, with the control valve assembly including a control valve disposed in the valve housing interior, and with the control valve being in a first control valve position.
Figure 5:
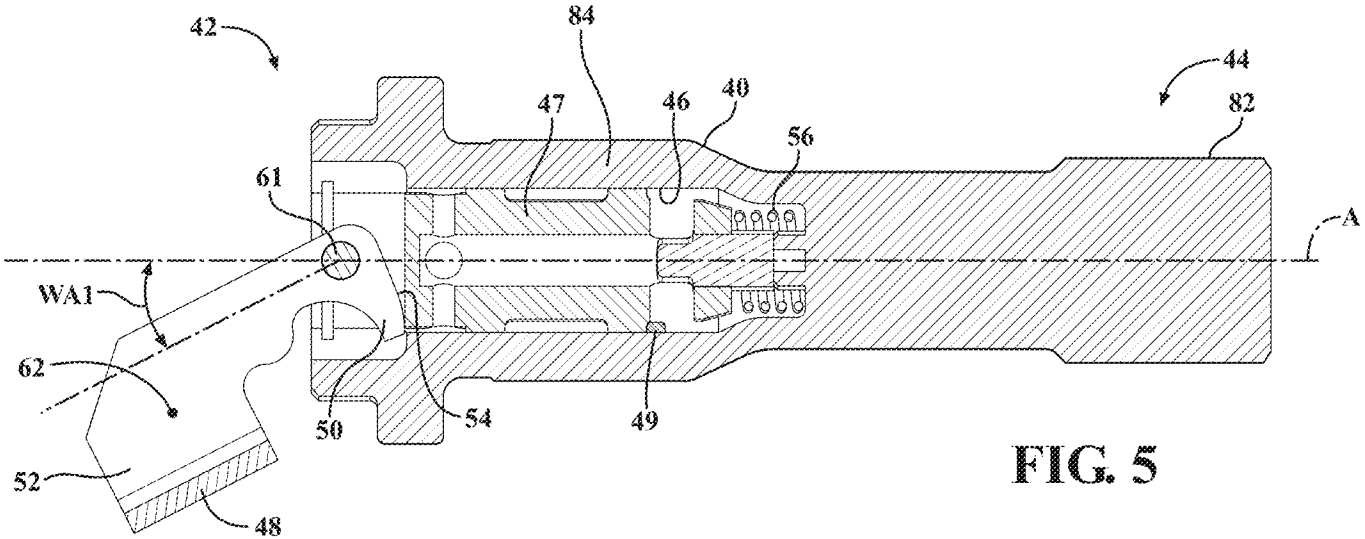
FIG. 5 is a cross-sectional view of the control valve assembly of FIG. 3, with the control valve being in a second control valve position.

With reference to FIGS. 3-5, the control valve assembly 20 includes a valve housing 40 extending along an axis A between a first valve housing end 42 and a second valve housing end 44. The valve housing 40 defines a valve housing interior 46. The valve housing 40 is configured to rotate about the axis A during operation of the variable cam timing phaser 22. The control valve assembly 20 also includes a control valve 47 disposed in the valve housing interior 46 and moveable along the axis A between a first control valve position adjacent the first valve housing end 42, as shown in FIG. 4, and a second control valve position spaced axially from the first control valve position toward the second valve housing end 44, as shown in FIG. 5. The first control valve position may be referred to as a default position, which refers to the position the control valve 47 is in when the RPM of the valve housing 40, and, therefore, the camshaft 38, is at zero or below a predetermined amount. The control valve assembly 20 further includes a weight 48 movably coupled to the valve housing 40. The weight 48 is configured to actuate the control valve 47 between the first and second control valve positions during rotation of the valve housing 40 about the axis A. It is to be appreciated that the control valve 47 may be moveable to additional control valve positions between the first control valve position and the second control valve position, such as a third control valve position. As described in further detail below, the control valve 47 may be moveable to numerous positions, which is typically dependent on the rotations per minute (RPM) of the valve housing 40 about the axis A, which is caused by rotation of the camshaft 38. In other words, depending on the RPM of the valve housing 40 about the axis A, the control valve 47 is moveable along the axis A, as described in further detail below.

The control valve assembly 20 including the weight 48 movably coupled to the valve housing 40 and with the weight 48 being configured to actuate the control valve 47 between the first and second control valve positions during rotation of the valve housing 40 about the axis A offers several advantages. First, having the weight 48 movably coupled to the valve housing 40 and with the weight 48 being configured to actuate the control valve 47 between the first and second control valve positions during rotation of the valve housing 40 results in a more compact variable cam timing phaser 22. Having a more compact variable cam timing phaser 22 allows the variable cam timing phaser 22 to occupy less space in an engine compartment. In one example, the variable cam timing phaser 22 may be free of an actuator, such as a solenoid, for moving the control valve 47 between the first and second control valve positions. Having the variable cam timing phaser 22 being free of an actuator, such as a solenoid, allows for a more compact design than variable cam timing phasers including an actuator. Additionally, as described in further detail below, the weight 48 can be adjusted based on the requirements of the variable cam timing phaser 22.

In one embodiment, the weight 48 may be referred to as a centrifugal weight. It is to be appreciated that other suitable configurations of the weight 48 may be used, such as including two or more weights, as described in further detail below. Additionally, in embodiments where the control valve assembly 20 includes two weights, the weights may be in the same plane or in multiple planes depending on the angular layout. Umbrella style weights and ball style weights may also be used.

In one embodiment, the weight 48 is pivotably coupled to the valve housing 40. The control valve assembly 20 may include a pivot pin 61 coupled to the valve housing 40 and the weight 48 with the weight 48 being pivotable about the pivot pin 61. The pivot pin 61 may be disposed in the valve housing interior 46. The weight 48 may be freely pivotably coupled to the valve housing 40 and, when present, the pivot pin 61. The weight 48 may be pivotable between a first weight position corresponding to the first control valve position, as shown in FIG. 4, and a second weight position corresponding to the second control valve position, as shown in FIG. 5. It is also to be appreciated that the weight 48 may be moveable to additional weight positions between the first and second weight positions, such as a third control valve position. As with the control valve 47, the weight 48 may also be moveable to numerous positions, which is typically dependent on the RPM of the valve housing 40 about the axis A. In other words, depending on the RPM of the valve housing 40 about the axis A, the weight 48 is moveable with respect to the valve housing 40, typically pivotable with respect to the valve housing 40, as described in further detail below.

When the weight 48 pivots with respect to the valve housing 40, the weight 48 defines a second weight angle WA2 with respect to the axis A. As the weight 48 pivots from the first weight position toward to the second weight position, as shown in FIGS. 4 and 5, the second weight angle WA2 increases.

As shown in FIGS. 4 and 5, the weight 48 may be engaged with the control valve 47 to move the control valve 47 between the first and second control valve positions. Specifically, when the weight 48 moves with respect to the valve housing 40 and, in some embodiments, when the weight 48 pivots with respect to the valve housing 40, the weight 48 engages the control valve 47 to move the control valve 47 between the first and second control valve positions. The weight 48 may be directly engaged with the control valve 47 to move the control valve 47 between the first and second control valve positions, or the weight 48 may have an intermediate component disposed between the weight 48 and the control valve 47.

The weight 48 may have a pivot portion 50 pivotably coupled to the valve housing 40 and an extension portion 52 extending from the pivot portion 50 away from the control valve 47. In such embodiments, the extension portion 52 may be moveable between a first extension position and a second extension position. The control valve 47 typically is in the first control valve position when the extension portion 52 is in the first extension position, as shown in FIG. 4, the control valve 47 typically is in the second control valve position when the extension portion 52 is in the second extension position, as shown in FIG. 5. Although not required, the pivot portion 50 may be disposed in the valve housing interior 46 and the extension portion 52 may be disposed outside of the valve housing interior 46. As noted above, the second weight angle WA2 changes as the weight 48 moves with respect to the axis A.

The extension portion 52 of the weight 48 typically includes the center of gravity 62 of the weight 48, which allows the extension portion 52 to move with respect to axis A. As described in further detail below, the location of the center of gravity 62 of the weight 48 can be adjusted based on the configuration of the extension portion 52 of the weight 48.

The pivot portion 50 may have an engagement surface 54 engageable with the control valve 47 with the engagement surface 54 being slidable against the control valve 47 when the extension portion 52 moves between the first and second extension positions. The engagement surface 54 may have a curved configuration. Specifically, as the engagement surface 54 slides against the control valve 47 when the extension portion 52 moves between the first and second extension positions, the configuration of the engagement surface 54, such as a curved configuration, causes the control valve 47 to move in the valve housing interior 46 as the weight 48 moves with respect to the axis A. More specifically, as the extension portion 52 moves away from the axis A during rotation of the valve housing 40, the engagement surface 54 moves such that the control valve 47 moves with respect to the axis A in the valve housing interior 46. The configuration of the engagement surface 54 may be adjusted based on the desired movement of the control valve 47, as described in further detail below.

The control valve assembly 20 may include a biasing member 56, such as a spring, disposed in the valve housing interior 46. When present, the biasing member 56 biases the control valve 47 toward the first valve housing end 42 and against the engagement surface 54 of the pivot portion 50. The force of the biasing member 56 applied to the control valve 47 may be tuned based on desired operation of the variable cam timing phaser 22, as described in further detail below.

During operation of the variable cam timing phaser 22, the valve housing 40 rotates about the axis A due to rotation of the camshaft 38. During rotation about the axis A, the weight 48 moves with respect to the valve housing 40 and actuates the control valve 47 against the bias of the biasing member 56. Typically, the weight 48 pivots about the pivot pin 61.

In one embodiment, as shown in FIGS. 4, 5, 7, and 8, the pivot portion 50 of the weight 48 is configured to push the control valve 47 from the first control valve position toward the second control valve position when the extension portion 52 moves from the first extension position toward the second extension position. In such embodiments, the biasing member 56 is typically disposed adjacent the second valve housing end 44.

Figure 9:
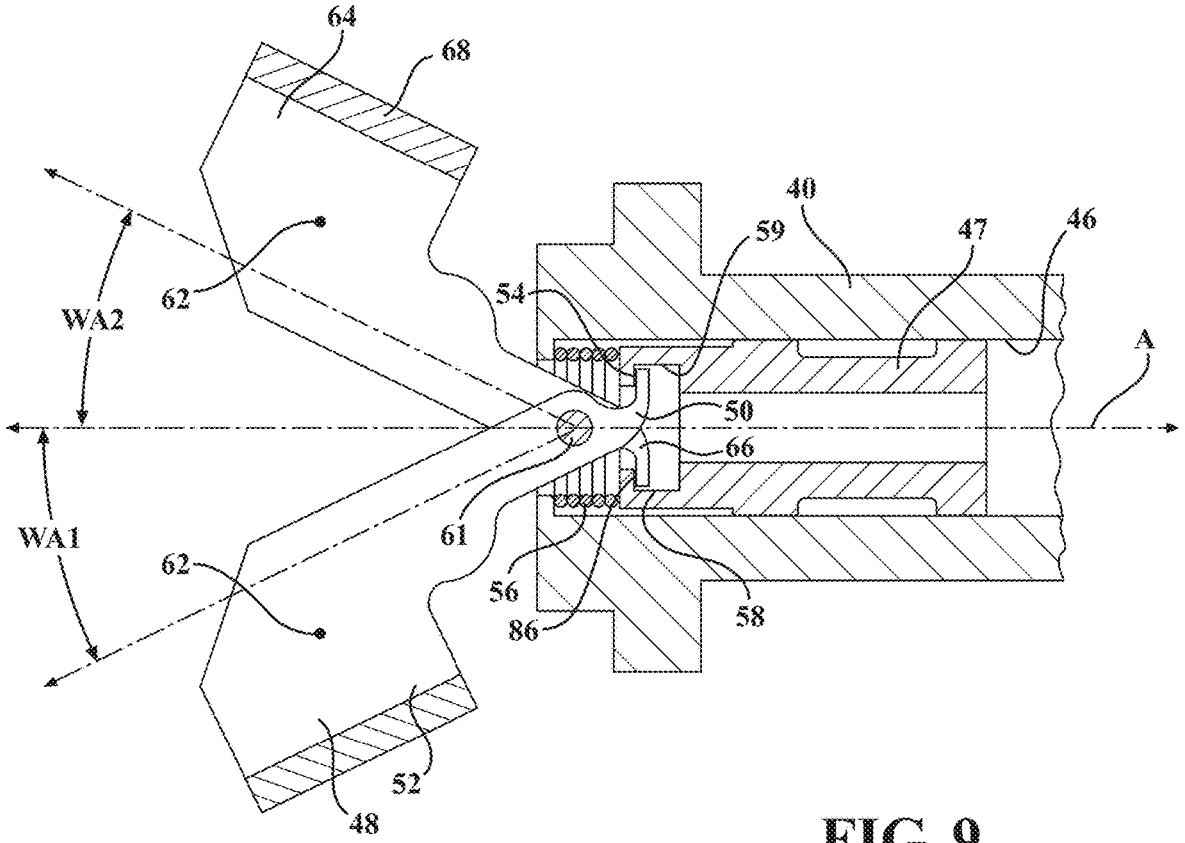
FIG. 9 is a cross-sectional view of another embodiment of the control valve assembly.
Figure 10:
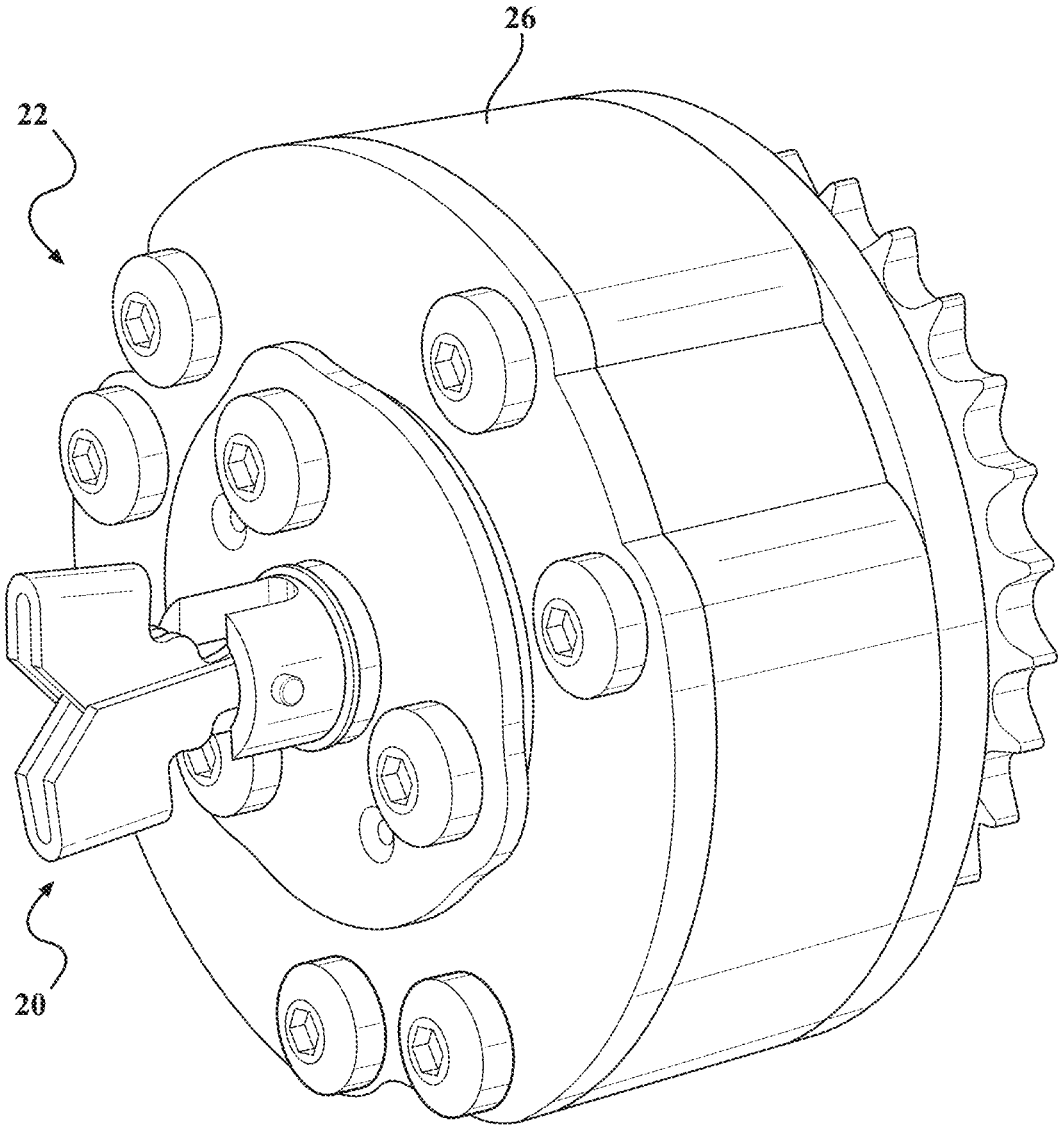
FIG. 10 is another embodiment of the variable cam timing phaser.

In another embodiment, as shown in FIG. 9, the control valve 47 defines a groove 58. In such embodiments, the pivot portion 50 may extend into the groove 58 and the pivot portion 50 of the weight 48 is configured to pull the control valve 47 from the second control valve position toward the first control valve position when the extension portion 52 moves from the first extension position toward the second extension position.

As described above, the configuration of the weight 48, the configuration of engagement surface 54, the force of the biasing member 56, the center of gravity 62 of the extension portion 52, and/or the configuration of the control valve 47 may be adjusted based on the desired activation RPM of the valve housing 40. In other words, the desired activation RPM of the valve housing 40 in which the control valve 47 moves may be changed by adjusting any one or combination of the factors listed above in this paragraph. For example, if the desired activation RPM is lower, which refers to the RPM of the valve housing 40 at which the control valve 47 begins to move along the axis A, then the force of the biasing member 56 can be reduced, the center of gravity 62 of the weight 48 can be moved further away from the pivot pin 61, the mass of the weight 48 can be increased, and/or the configuration of the engagement surface 54 and control valve 47 may be adjusted. On the other hand, if the desired activation RPM is higher, then the force of the biasing member 56 may be increased, the center of gravity 62 of the weight 48 may be moved closer to the pivot pin 61, the mass of the weight 48 can be decreased, and/or the configuration of the engagement surface 54 and control valve 47 may be adjusted. As the RPM of the valve housing 40 is reduced, the control valve 47 begins to move back toward the first control valve position when the RPM of the valve housing 40 is below the activation RPM. Additionally, the configuration of the weight 48 may be adjusted to balance the variable cam timing phaser 22, such as in embodiments where the rotor 30 is imbalanced.

Although not required, to further control the movement of the control valve 47, the control valve assembly 20 may include a stop 49 for restricting movement of the control valve 47 beyond a predetermined distance. The stop 49 may be disposed in the valve housing interior 46. For example, as the valve housing 40 begins to rotate about the axis A, the weight 48 may move the control valve 47 along the axis A, which then allows oil to flow into and out of the valve housing 40 to actuate the rotor 30 with respect to the housing 26. After a predetermined movement of the control valve 47 is achieved, the control valve 47 may be held in place, such as by the stop 49, and then the control valve 47 may move back as the RPM of the valve housing 40 decreases. During movement of the control valve 47, oil is controlled by the control valve 47 to direct the hydraulic fluid into and out of the advance chambers 37 and retard chambers 39 to rotate the rotor 30 and the camshaft 35 with respect to the housing 26.

In one embodiment, as shown in FIGS. 6-9, the weight 48 is further defined as a first weight 48, and the control valve assembly 20 further includes a second weight 64 movably coupled to the valve housing 40. When present, the first and second weights 48, 64 are configured to actuate the control valve 47 between the first and second control valve positions during rotation of the valve housing 40 about the axis A. It is to be appreciated that the description set forth above with respect to the weight 48 equally applies to the second weight 64, such as the configuration of the engagement surface 54, the configuration of the extension portion 52, the location of the center of gravity 62 of the extension portion 52, etc.

Figure 6:
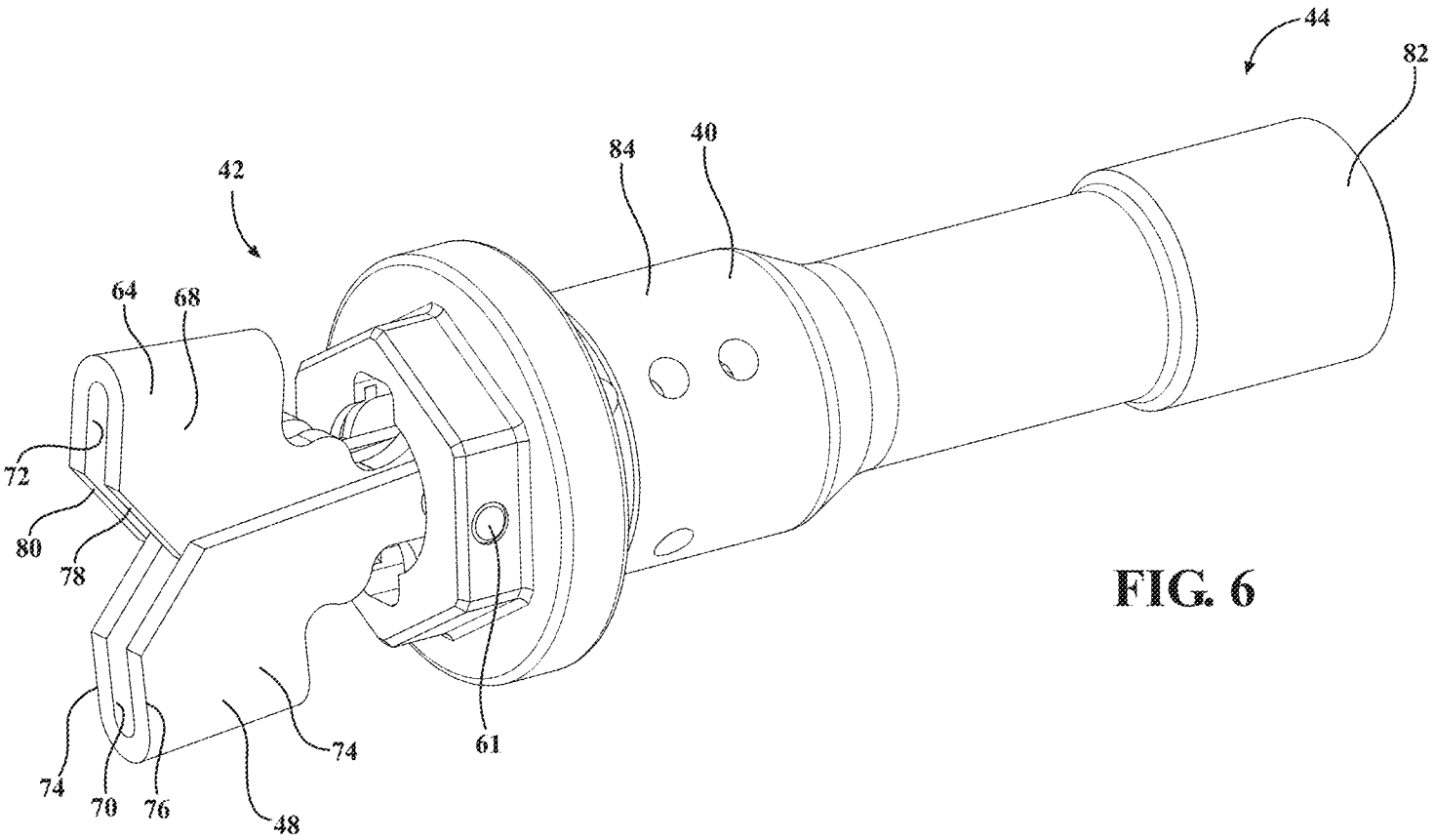
FIG. 6 is a is a perspective view of another embodiment of the control valve assembly, with the weight being further defined as a first weight, and with the control valve assembly further including a second weight.
Figure 7:
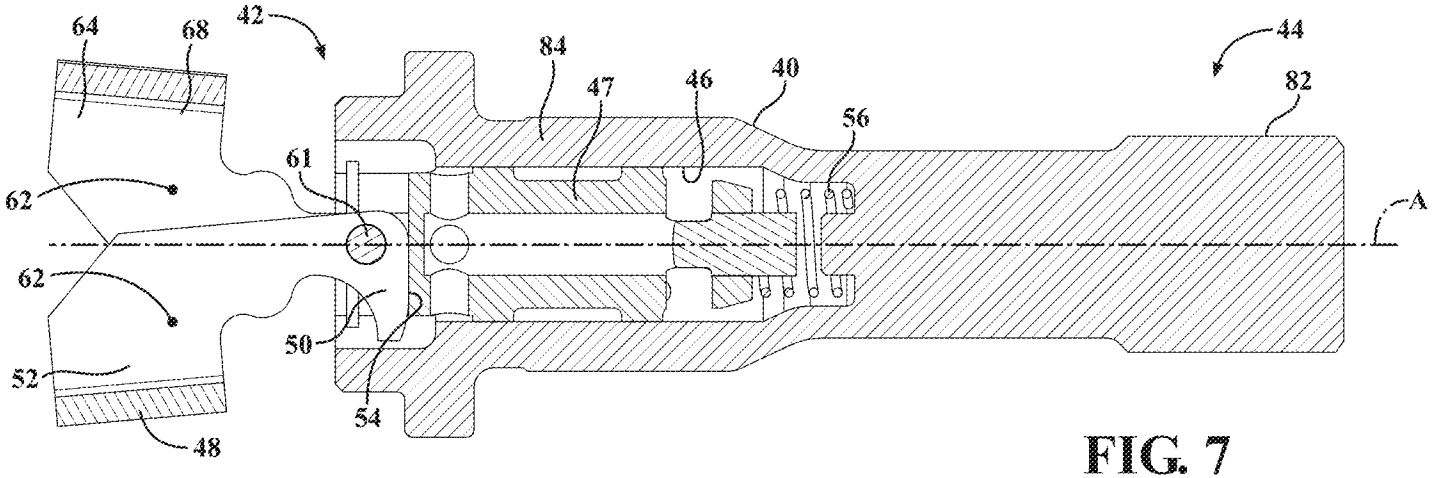
FIG. 7 is a cross-sectional view of the control valve assembly of FIG. 6, with the control valve being in a first control valve position.
Figure 8:
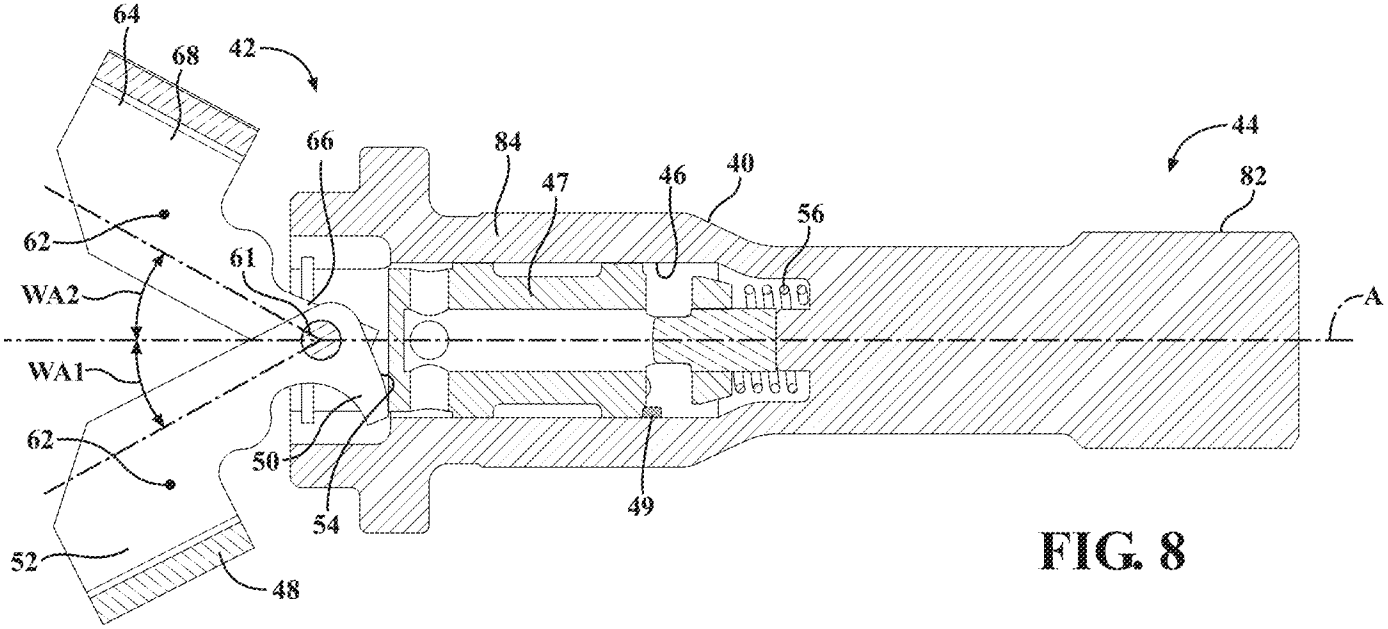
FIG. 8 is a cross-sectional view of the control valve assembly of FIG. 6, with the control valve being in a second control valve position.

With reference to FIGS. 6-8, the pivot portion 50 of the first weight 48 is further defined as a first pivot portion 50 and the extension portion 52 of the first weight 48 is further defined as a first extension portion 52. The second weight 64 may have a second pivot portion 66 pivotably coupled to the valve housing 40 and a second extension portion 68 extending from the second pivot portion 66 away from the control valve 47. The control valve 47 may be in the first control valve position when the first and second extension portions 52, 68 are in a first extension position, and the control valve 47 may be in the second control valve position when the first and second extension portions 52, 68 are in a second extension position.

The first extension portion 52 may define a first extension groove 70 and the second extension portion 68 may define a second extension groove 72. When present, the first extension portion 52 may be disposed in the second extension groove 72 when the first and second extension portions 52, 68 are in the first extension position.

The first extension groove 70 may be defined by a first and second arm 74, 76 of the first extension portion 52 and the second extension groove 72 may be defined by a first and second arm 78, 80 of the second extension portion 68. In such embodiments, the first arm 74 of the first extension portion 52 is disposable in the second extension groove 72 when the first extension portion 52 is in the first extension position and the first arm 78 of the second extension portion 68 is disposable in the first extension groove 70 when the second extension portion 68 is in the first extension position.

With reference to FIG. 9, the control valve 47 may define a groove 58 and a second groove 60. In such embodiments, the pivot portion 50 may extend into the groove 58 and the second pivot portion 66 may extend into the second groove 60 such that the first and second pivot portions 50, 66 of the weight 48 and second weight 64, respectively, are configured to pull the control valve 47 from the second control valve position toward the first control valve position when the extension portion 52 moves from the first extension position toward the second extension position. The second pivot portion 66 may have a second engagement surface 86 engageable with the control valve 47.

Figure 11:
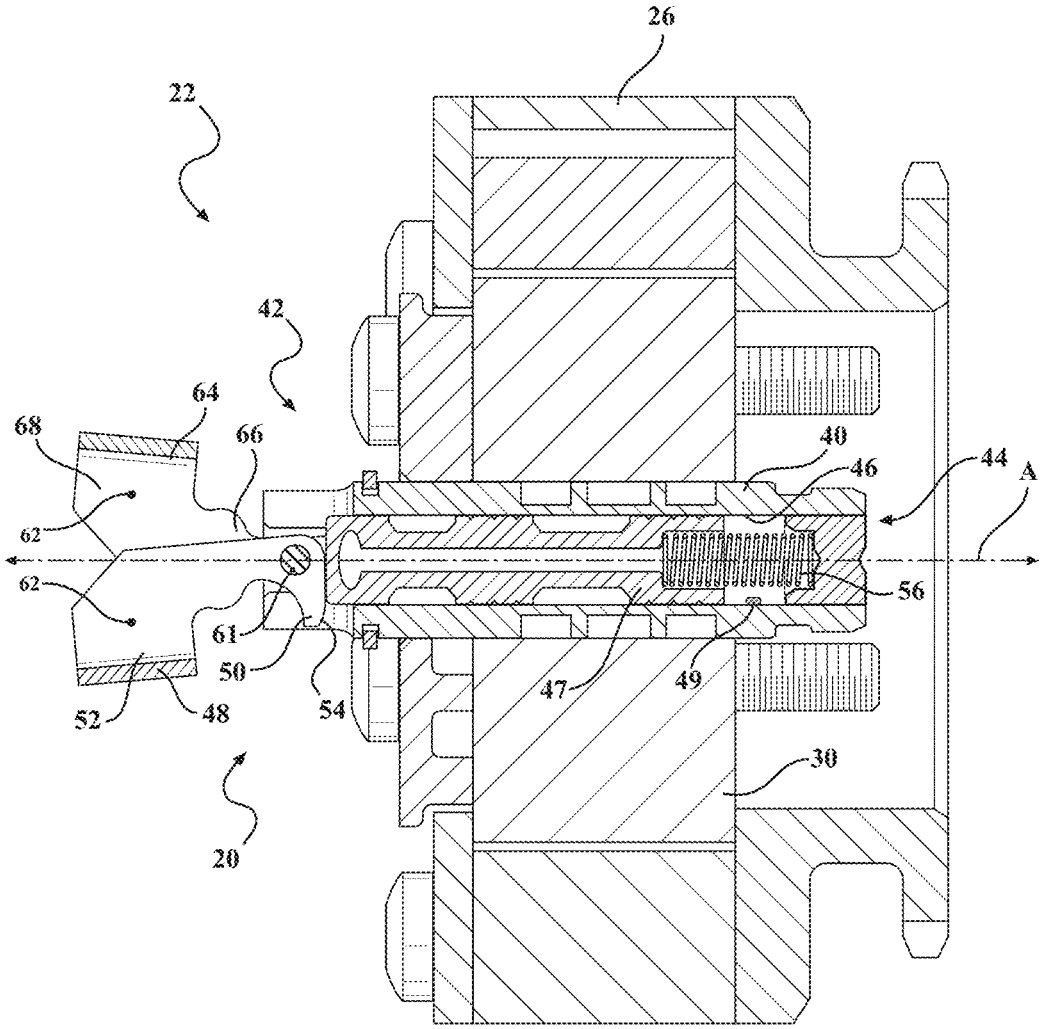
FIG. 11 is a cross-sectional view of the variable cam timing phaser of FIG. 10.

The valve housing 40 may include a threaded portion 82 adapted to engage the camshaft 38 to fix the valve housing 40 to the camshaft 38. It is to be appreciated that the valve housing 40 including the threaded portion 82 adapted to engage the camshaft 38 to fix the valve housing 40 to the camshaft 38 may also be, or alternatively be, adapted to fix the variable cam timing phaser 22 to the camshaft 38. The valve housing 40 may include a body portion 84 spaced axially from the threaded portion 82 along the axis A. The body portion 84 typically defines the valve housing interior 46. It is to be appreciated that the valve housing 40 may be coupled to the camshaft 38 in any suitable manner, such as the valve housing 40 being pressed into the rotor 30, as shown in FIG. 11, and such as using a snap ring for axially retaining the valve housing 40 with respect to the camshaft 38.

Figure 12:
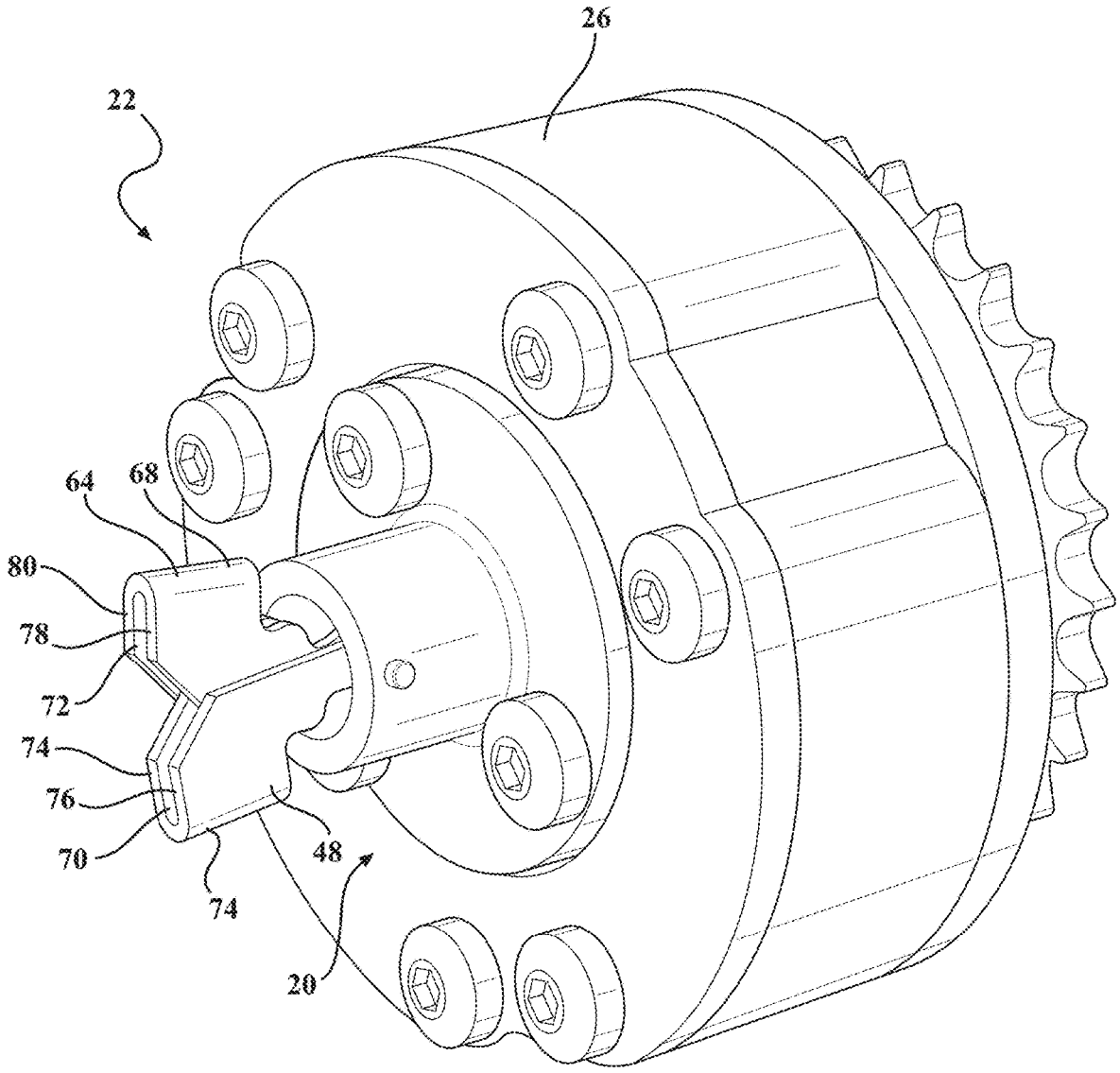
FIG. 12 is another embodiment of the variable cam timing phaser.
Figure 13:
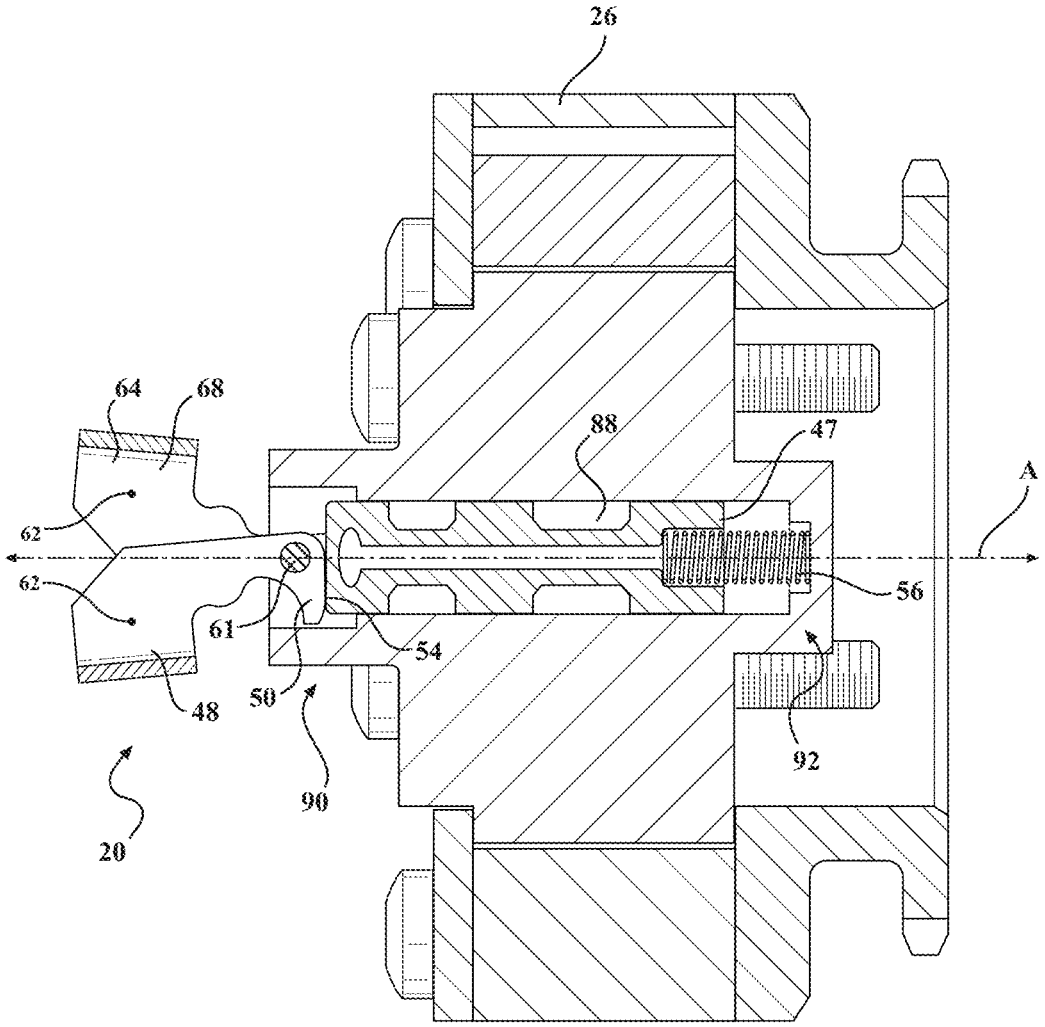
FIG. 13 is a cross-sectional view of the variable cam timing phaser of FIG. 12.

In another embodiment of the variable cam timing phaser 22, as shown in FIGS. 12 and 13, the rotor 30 extends along the axis A between a first rotor end 90 and a second rotor end 92. The rotor 30 defines a rotor interior 88. The rotor 30 is configured to rotate about the axis A during operation of the variable cam timing phaser 22. The variable cam timing phaser 22 also includes the control valve 47 disposed in the rotor interior 46 and moveable along the axis A between a first control valve position adjacent the first rotor end 90 and a second control valve position spaced axially from the first control valve position toward the second rotor end 92. The first control valve position may be referred to as a default position, which refers to the position the control valve 47 is in when the RPM of the rotor 30, and, therefore, the camshaft 38, is at zero or below a predetermined amount. The variable cam timing phaser 22 further includes the weight 48 movably coupled to the rotor 30. The weight 48 is configured to actuate the control valve 47 between the first and second control valve positions during rotation of the rotor 30 about the axis A. It is to be appreciated that the control valve 47 may be moveable to additional control valve positions between the first control valve position and the second control valve position, such as a third control valve position. As described in further detail above, the control valve 47 may be moveable to numerous positions, which is typically dependent on the rotations per minute (RPM) of the rotor 30 about the axis A, which is caused by rotation of the camshaft 38. In other words, depending on the RPM of the rotor 30 about the axis A, the control valve 47 is moveable along the axis A, as described in further detail below.

The variable cam timing phaser 22 including the weight 48 movably coupled to the rotor 30 and with the weight 48 being configured to actuate the control valve 47 between the first and second control valve positions during rotation of the rotor 30 about the axis A offers several advantages. First, having the weight 48 movably coupled to the rotor 30 and with the weight 48 being configured to actuate the control valve 47 between the first and second control valve positions during rotation of the rotor 30 results in a more compact variable cam timing phaser 22. Having a more compact variable cam timing phaser 22 allows the variable cam timing phaser 22 to occupy less space in an engine compartment. In one example, the variable cam timing phaser 22 may be free of an actuator, such as a solenoid, for moving the control valve 47 between the first and second control valve positions. Having the variable cam timing phaser 22 being free of an actuator, such as a solenoid, allows for a more compact design than variable cam timing phasers including an actuator. Additionally, as described in further detail below, the weight 48 can be adjusted based on the requirements of the variable cam timing phaser 22.

In one embodiment, the weight 48 may be referred to as a centrifugal weight. It is to be appreciated that other suitable configurations of the weight 48 may be used, such as including two or more weights, as described in further detail below. Additionally, in embodiments where the variable cam timing phaser 22 includes two weights, the weights may be in the same plane or in multiple planes depending on the angular layout. Umbrella style weights and ball style weights may also be used.

In one embodiment, the weight 48 is pivotably coupled to the rotor 30. The variable cam timing phaser 22 may include the pivot pin 61 coupled to the rotor 30 and the weight 48 with the weight 48 being pivotable about the pivot pin 61. The pivot pin 61 may be disposed in the rotor interior 88. The weight 48 may be freely pivotably coupled to the rotor 30 and, when present, the pivot pin 61. The weight 48 may be pivotable between a first weight position corresponding to the first control valve position and a second weight position corresponding to the second control valve position. It is to be appreciated that the movement of the weight 48 described above with respect to FIGS. 3-9 equally applies to FIGS. 12 and 13. It is also to be appreciated that the weight 48 may be moveable to additional weight positions between the first and second weight positions, such as a third control valve position. As with the control valve 47, the weight 48 may also be moveable to numerous positions, which is typically dependent on the RPM of the rotor 30 about the axis A. In other words, depending on the RPM of the rotor 30 about the axis A, the weight 48 is moveable with respect to the rotor 30, typically pivotable with respect to the rotor 30, as described in further detail below.

When the weight 48 pivots with respect to the rotor 30, the weight 48 defines a second weight angle WA2 with respect to the axis A. As the weight 48 pivots from the first weight position toward to the second weight position the second weight angle WA2 increases. It is to be appreciated that the description of the weight 48 shown in FIGS. 4 and 5 equally applies to the weight 48 shown in FIGS. 12 and 13.

As described above with respect to FIGS. 4 and 5, the weight 48 of FIGS. 12 and 13 may similarly be engaged with the control valve 47 to move the control valve 47 between the first and second control valve positions. Specifically, when the weight 48 moves with respect to the rotor 30 and, in some embodiments, when the weight 48 pivots with respect to the rotor 30, the weight 48 engages the control valve 47 to move the control valve 47 between the first and second control valve positions. The weight 48 may be directly engaged with the control valve 47 to move the control valve 47 between the first and second positions, or the weight 48 may have an intermediate component disposed between the weight 48 and the control valve 47.

With reference to FIG. 13, the weight 48 may have the pivot portion 50 pivotably coupled to the rotor 30 and the extension portion 52 extending from the pivot portion 50 away from the control valve 47. In such embodiments, the extension portion 52 may be moveable between a first extension position and a second extension position. The control valve 47 typically is in the first control valve position when the extension portion is in the first extension position and the control valve 47 typically is in the second control valve position when the extension portion 52 is in the second extension position. Although not required, the pivot portion 50 may be disposed in the rotor interior 88 and the extension portion 52 may be disposed outside of the rotor interior 88.

The extension portion 52 of the weight 48 typically includes the center of gravity 62 of the weight 48, which allows the extension portion 52 to move with respect to axis A. As described in further detail above, the location of the center of gravity 62 of the weight 48 can be adjusted based on the configuration of the extension portion 52 of the weight 48.

With continued reference to FIG. 13, the pivot portion 50 may have the engagement surface 54 engageable with the control valve 47 with the engagement surface 54 being slidable against the control valve 47 when the extension portion 52 moves between the first and second extension positions. The engagement surface 54 may have a curved configuration. Specifically, as the engagement surface 54 slides against the control valve 47 when the extension portion 52 moves between the first and second extension positions, the configuration of the engagement surface 54, such as a curved configuration, causes the control valve 47 to move in the valve housing interior 46 as the weight 48 moves with respect to the axis A. More specifically, as the extension portion 52 moves away from the axis A during rotation of the rotor 30, the engagement surface 54 moves such that the control valve 47 moves with respect to the axis A in the valve housing interior 46. The configuration of the engagement surface 54 may be adjusted based on the desired movement of the control valve 47, as described in further detail above.

The variable cam timing phaser 22 may include the biasing member 56, such as a spring, disposed in the rotor interior 88. When present, the biasing member 56 biases the control valve 47 toward the first rotor end 90 and against the engagement surface 54 of the pivot portion 50. The force of the biasing member 56 applied to the control valve 47 may be tuned based on desired operation of the variable cam timing phaser 22, as described in further detail above.

During operation of the variable cam timing phaser 22, the rotor 30 rotates about the axis A due to rotation of the camshaft 38. During rotation about the axis A, the weight 48 moves with respect to the rotor 30 and actuates the control valve 47 against the bias of the biasing member 56. Typically, the weight 48 pivots about the pivot pin 61.

The pivot portion 50 of the weight 48 in FIG. 13 is configured to push the control valve 47 from the first control valve position toward the second control valve position when the extension portion 52 moves from the first extension position toward the second extension position. In such embodiments, the biasing member 56 is typically disposed adjacent the second valve housing end 44. It is to be appreciated that the pivot portion 50 of the weight 48 may also be configured to pull the control valve 47 from the first control valve position toward the second control valve position when the extension portion 52 moves from the first extension position toward the second extension position. In other words, the embodiment of the control valve 47 and weight 48 shown in FIG. 9 could similarly be used in the embodiment of FIG. 13 such that the weight 48 is movably coupled to the rotor 30.

As described above, the configuration of the weight 48, the configuration of engagement surface 54, the force of the biasing member 56, the center of gravity 62 of the extension portion 52, and/or the configuration of the control valve 47 may be adjusted based on the desired activation RPM of the rotor 30. In other words, the desired activation RPM of the rotor 30 in which the control valve 47 moves may be changed by adjusting any one or combination of the factors listed above in this paragraph. For example, if the desired activation RPM is lower, which refers to the RPM of the rotor 30 at which the control valve 47 begins to move along the axis A, then the force of the biasing member 56 can be reduced, the center of gravity 62 of the weight 48 can be moved further away from the pivot pin 61, the mass of the weight 48 can be increased, and/or the configuration of the engagement surface 54 and control valve 47 may be adjusted. On the other hand, if the desired activation RPM is higher, then the force of the biasing member 56 may be increased, the center of gravity 62 of the weight 48 may be moved closer to the pivot pin 61, the mass of the weight 48 can be decreased, and/or the configuration of the engagement surface 54 and control valve 47 may be adjusted. As the RPM of the rotor 30 is reduced, the control valve 47 begins to move back toward the first control valve position when the RPM of the rotor 30 is below the activation RPM. Additionally, the configuration of the weight 48 may be adjusted to balance the variable cam timing phaser 22, such as in embodiments where the rotor 30 is imbalanced.

Although not required, to further control the movement of the control valve 47, the variable cam timing phaser 22 may include a stop 49 for restricting movement of the control valve 47 beyond a predetermined distance. The stop 49 may be disposed in the rotor interior 88. For example, as the rotor 30 begins to rotate about the axis A, the weight 48 may move the control valve 47 along the axis A, which then allows oil to flow into and out of the rotor interior 88 to actuate the rotor 30 with respect to the housing 26. After a predetermined movement of the control valve 47 is achieved, the control valve 47 may be held in place, such as by the stop 49, and then the control valve 47 may move back as the RPM of the rotor 30 decreases. During movement of the control valve 47, hydraulic fluid is controlled by the control valve 47 to direct the hydraulic fluid into and out of the advance chambers 37 and retard chambers 39 to rotate the rotor 30 and the camshaft 35 with respect to the housing 26.

As described in detail above, the weight 48 may be further defined as the first weight 48, and the variable cam timing phaser 22 may further include the second weight 64 movably coupled to the rotor 30. Although the variable cam timing phaser 22 shown in FIGS. 12 and 13 show the first and second weights 48, 64, it is to be appreciated that the variable cam timing phaser 22 of FIGS. 12 and 13 may only have one weight 48, as described with respect to FIGS. 3-5 above. When present, the first and second weights 48, 64 are configured to actuate the control valve 47 between the first and second control valve positions during rotation of the rotor 30 about the axis A. It is to be appreciated that the description set forth above with respect to the weight 48 and the second weight 64, such as the configuration of the engagement surface 54, the configuration of the extension portion 52, the location of the center of gravity 62 of the extension portion 52, etc., equally applies to the first and second weight 48, 64 of FIGS. 12 and 13.

In another embodiment of the variable cam timing phaser 22, the variable cam timing phaser 22 includes a component that extends along the axis A between a first component end and a second component end. The component defines a component interior. The component is configured to rotate about the axis A during operation of the variable cam timing phaser 22. The variable cam timing phaser 22 also includes the control valve 47 disposed in the component interior and moveable along the axis A between a first control valve position adjacent the first component end and a second control valve position spaced axially from the first control valve position toward the second component end. The first control valve position may be referred to as a default position, which refers to the position the control valve 47 is in when the RPM of the component is at zero or below a predetermined amount. The variable cam timing phaser 22 further includes the weight 48 movably coupled to the component. The weight 48 is configured to actuate the control valve 47 between the first and second control valve positions during rotation of the component about the axis A. It is to be appreciated that the control valve 47 may be moveable to additional control valve positions between the first control valve position and the second control valve position, such as a third control valve position. As described in further detail above, the control valve 47 may be moveable to numerous positions, which is typically dependent on the rotations per minute (RPM) of the component about the axis A, which is caused by rotation of the camshaft 38. In other words, depending on the RPM of the component about the axis A, the control valve 47 is moveable along the axis A, as described in further detail above. It is to be appreciated that the component may be any suitable component of the variable cam timing phaser 22 that the weight is moveably coupled to, such as the rotor 30, the valve housing 40, and the like.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A control valve assembly of a variable cam timing phaser, said control valve assembly comprising:

a valve housing extending along an axis between a first valve housing end and a second valve housing end and defining a valve housing interior, wherein said valve housing is configured to rotate about said axis during operation of the variable cam timing phaser;

a control valve disposed in said valve housing interior and moveable along said axis between a first control valve position adjacent said first valve housing end and a second control valve position spaced axially from said first control valve position toward said second valve housing end; and a weight movably coupled to said valve housing;

wherein said weight is configured to actuate said control valve between said first and second control valve positions during rotation of said valve housing about said axis.

2. The control valve assembly as set forth in claim 1, wherein said weight is pivotably coupled to said valve housing.

3. The control valve assembly as set forth in claim 1, wherein said weight is engaged with said control valve to move said control valve between said first and second control valve positions.

4. The control valve assembly as set forth in claim 3, wherein said weight is directly engaged with said control valve to move said control valve between said first and second control valve positions.

5. The control valve assembly as set forth in claim 1, wherein said weight has a pivot portion pivotably coupled to said valve housing and an extension portion extending from said pivot portion away from said control valve, and wherein said control valve is in said first control valve position when said extension portion is in a first extension position, and said control valve is in said second control valve position when said extension portion is in a second extension position.

6. The control valve assembly as set forth in claim 5, wherein said pivot portion is disposed in said valve housing interior and said extension portion is disposed outside of said valve housing interior.

7. The control valve assembly as set forth in claim 6, wherein said control valve defines a groove, wherein said pivot portion extends into said groove, and wherein said pivot portion of said weight is configured to pull said control valve from said second control valve position toward said first control valve position when said extension portion moves from said first extension position toward said second extension position.

8. The control valve assembly as set forth in claim 5, wherein said pivot portion has an engagement surface engageable with said control valve, and wherein said engagement surface is slidable against said control valve when said extension portion moves between said first and second extension positions.

9. The control valve assembly as set forth in claim 8, wherein said engagement surface has a curved configuration.

10. The control valve assembly as set forth in claim 5, wherein said pivot portion of said weight is configured to push said control valve from said first control valve position toward said second control valve position when said extension portion moves from said first extension position toward said second extension position.

11. The control valve assembly as set forth in claim 1, further comprising a biasing member disposed in said valve housing interior, wherein said biasing member biases said control valve toward said first valve housing end.

12. The control valve assembly as set forth in claim 1, further comprising a pivot pin coupled to said valve housing and said weight, wherein said weight is pivotable about said pivot pin.

13. The control valve assembly as set forth in claim 12, wherein said pivot pin is disposed in said valve housing interior.

14. The control valve assembly as set forth in claim 1, wherein said weight is further defined as a first weight, and further comprising a second weight movably coupled to said valve housing, and wherein said first and second weights are configured to actuate said control valve between said first and second control valve positions during rotation of said valve housing about said axis.

15. The control valve assembly as set forth in claim 14, wherein said pivot portion of said first weight is further defined as a first pivot portion, wherein said extension portion of said first weight is further defined as a first extension portion, and wherein said second weight has a second pivot portion pivotably coupled to said valve housing and a second extension portion extending from said second pivot portion away from said control valve, and wherein said control valve is in said first control valve position when said first and second extension portions are in a first extension position, and said control valve is in said second control valve position when said first and second extension portions are in a second extension position.

16. The control valve assembly as set forth in claim 15, wherein said first extension portion defines a first extension portion groove, wherein said second extension portion defines a second extension portion groove, and wherein said first extension portion is disposed in said second extension portion groove when said first and second extension portions are in said first extension position.

17. The control valve assembly as set forth in claim 16, wherein said first extension portion groove is defined by a first and second arm of said first extension portion, wherein said second extension portion groove is defined by a first and second arm of said second extension portion, and wherein said first arm of said first extension portion is disposable in said second extension groove when said first extension portion is in said first extension position and said first arm of said second extension portion is disposable in said first extension groove when said second extension portion is in said first extension position.

18. The control valve assembly as set forth in claim 1, wherein said valve housing comprises a threaded portion adapted to engage the camshaft to fix said valve housing to the camshaft, and a body portion spaced axially from said threaded portion along said axis, and with said body portion disposed about said axis and defining said valve housing interior.

19. A variable cam timing phaser of a variable cam timing system, with the variable cam timing system including a camshaft, said variable cam timing phaser comprising:

a housing defining a housing interior;

a rotor disposed in said housing interior and moveable with respect to said housing; and said control valve assembly as set forth in claim 1.

20. A variable cam timing system comprising:

said variable cam timing phaser as set forth in claim 19; and a camshaft rotatably coupled to said rotor of said variable cam timing phaser.

21. A variable cam timing phaser of a variable cam timing system, with the variable cam timing system including a camshaft, said variable cam timing phaser comprising:

a housing defining a housing interior;

a rotor disposed in said housing interior and moveable with respect to said housing, wherein said rotor extends along an axis between a first rotor end and a second rotor end and defines a rotor interior, and wherein said rotor is configured to rotate about said axis during operation of the variable cam timing phaser;

a control valve disposed in said rotor interior and moveable along said axis between a first control valve position adjacent said first rotor end and a second control valve position spaced axially from said first control valve position toward said second rotor end; and a weight movably coupled to said rotor;

wherein said weight is configured to actuate said control valve between said first and second control valve positions during rotation of said rotor about said axis.

22. The variable cam timing phaser as set forth in claim 21, wherein said weight is pivotably coupled to said rotor.

23. The variable cam timing phaser as set forth in claim 21, wherein said weight is engaged with said control valve to move said control valve between said first and second control valve positions.

24. The variable cam timing phaser as set forth in claim 21, wherein said weight is further defined as a first weight, and further comprising a second weight movably coupled to said rotor, and wherein said first and second weights are configured to actuate said control valve between said first and second control valve positions during rotation of said rotor about said axis.

25. The variable cam timing phaser as set forth in claim 24, wherein said first weight has a first pivot portion pivotably coupled to said rotor and a first extension portion extending from said first pivot portion away from said rotor, wherein said second weight has a second pivot portion pivotably coupled to said rotor and a second extension portion extending from said second pivot portion away from said rotor, and wherein said control valve is in said first control valve position when said first and second extension portions are in a first extension position, and said control valve is in said second control valve position when said first and second extension portions are in a second extension position.

* * * * *